US008738156B2

(12) United States Patent
Ahmadshahi

(10) Patent No.: US 8,738,156 B2
(45) Date of Patent: May 27, 2014

(54) CLAP-OFF BRA

(71) Applicant: Michael Mansour Ahmadshahi, Laguna Niguel, CA (US)

(72) Inventor: Michael Mansour Ahmadshahi, Laguna Niguel, CA (US)

(73) Assignee: Biometric Lingerie, Inc., Irvine, CA (US)

( * ) Notice: Subject to any disclaimer, the term of this patent is extended or adjusted under 35 U.S.C. 154(b) by 0 days.

(21) Appl. No.: 13/744,985

(22) Filed: Jan. 18, 2013

(65) Prior Publication Data

US 2013/0125349 A1 May 23, 2013

Related U.S. Application Data

(63) Continuation of application No. 11/977,076, filed on Oct. 22, 2007.

(60) Provisional application No. 60/853,210, filed on Oct. 20, 2006.

(51) Int. Cl.
*G05B 15/00* (2006.01)

(52) U.S. Cl.
USPC ..... 700/1; 340/5.52; 382/115

(58) Field of Classification Search
CPC ..... A41D 1/002; A41F 1/002
USPC ..... 700/1, 12; 340/5.52, 5.54, 5.8, 5.81, 340/5.82, 5.83, 5.84, 5.85; 382/115
See application file for complete search history.

(56) References Cited

U.S. PATENT DOCUMENTS

| | | | | |
|---|---|---|---|---|
| 4,878,879 | A | 11/1989 | Kunstadter | |
| 5,235,974 | A | 8/1993 | Miller | |
| 5,570,528 | A | 11/1996 | Teetzel | |
| 6,147,611 | A | 11/2000 | Otero | |
| 6,198,204 | B1 | 3/2001 | Pottenger | |
| 6,547,130 | B1 | 4/2003 | Shen | |
| 6,742,683 | B1 | 6/2004 | Phan | |
| 6,954,133 | B2 | 10/2005 | McGregor et al. | |
| 7,023,320 | B2 | 4/2006 | Dvorak | |
| 2003/0166375 | A1 | 9/2003 | Noel et al. | |
| 2005/0010096 | A1 | 1/2005 | Blackadar | |
| 2005/0223479 | A1 | 10/2005 | Griffits et al. | |
| 2005/0275542 | A1 | 12/2005 | Weekes | |
| 2008/0092341 | A1 | 4/2008 | Ahmadshahi | |
| 2008/0285388 | A1* | 11/2008 | Ohguri et al. | 367/198 |
| 2011/0225697 | A1* | 9/2011 | Griffits et al. | 2/69 |

OTHER PUBLICATIONS

Szczys. Mike; "Clap to remove this brassiere"; Feb. 14, 2011; pp. 1.*
Asser, Martin "Sexy secrets of the Syrian souk"; Dec. 16, 2008.*
Exhibit-A: Prosecution History of U.S. Appl. No. 11/977,076.

* cited by examiner

*Primary Examiner* — Sean Shechtman
*Assistant Examiner* — Chad Rapp
(74) *Attorney, Agent, or Firm* — Ahmadshahi & Associates

(57) ABSTRACT

A bra comprises a signal-activated fastener which may be utilized to unfasten the bra when the signal-activated fastener receives a clapping sound generated by a person clapping his/her hands. Specifically, a strapless bra includes a sensor, a controller, and a fastener assembly cooperating to cause the bra to unfasten upon reception of the clapping sound.

11 Claims, 3 Drawing Sheets

CLAP-OFF BRA

CROSS REFERENCE TO RELATED APPLICATIONS

The present patent application is a continuation of a co-pending non-provisional patent application entitled "BIOMETRIC GARMENT AND METHOD OF OPERATION," filed Oct. 22, 2007, as U.S. patent application Ser. No. 11/977,076 by the same inventor, which in turn, was the formalization of a previously filed, co-pending provisional patent application entitled "BIOMETRIC GARMENT AND METHOD OF OPERATION," filed Oct. 20, 2006, as U.S. patent application Ser. No. 60/853,210 by the inventor. This patent application claims the benefit of the filing date of the cited non-provisional and provisional patent applications according to the statutes and rules governing provisional and non-provisional patent applications, particularly 35 USC §§119, 120, 121, and 37 CFR §1.78. The specification and drawings of the cited provisional and non-provisional patent applications are specifically incorporated herein by reference.

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

This invention is related to garments comprising a signal-activated fastener. In particular, the present invention relates to a garment, including a method of operating the garment, wherein the signal-activated fastener receives a signal and at least one of fastens and unfastens the garment according to the signal. Specifically, the present disclosure relates to a bra comprising a signal-activated fastener which may he utilized to unfasten the bra when the signal-activated fastener receives a clapping sound generated by a person clapping his/her hands.

BACKGROUND

Lingerie, such as bras which are worn by females, have a fastening mechanism, such as a hook-type fastener, which is difficult to open, especially for the male counterpart. A bra according to the present invention could be made using a signal-activated fastener such that the female's boyfriend or husband could clap his hand and the bra would automatically open.

The present state of the art in using authentication systems in variety of applications is well known to skilled artisans. In particular, voice or fingerprint authentication systems are routinely utilized in security applications. The present invention combines the existing technology of authentication with an article of clothing. Specifically, the present disclosure is a signal-activated bra which comprises a signal-activated fastener operative to unfasten the bra when said signal-activated fastener receives the clapping sound generated by a person clapping his/her hands.

The present invention disclosure further illustrates a signal-activated garment comprising a signal-activated fastener whereby the garment may be fastened or unfastened when a signal, received by the signal-activated fastener, substantially matches a predetermined signal. Various types of garments and voice-activated fasteners can he utilized. In one preferred embodiment, a brassiere comprises to signal-activated fastener whereby the brassiere may be fastened or unfastened when a biometric voice signal substantially matches a predetermined signal stored in the memory of a controller included in the signal-activated fastener. in another embodiment, an object, such as a communication device, may be secured/released to/from a signal-activated garment of the present invention.

SUMMARY

The present invention discloses a bra, including a method of operation, which comprises a signal-activated fastener which may be utilized to unfasten the bra when the signal-activated fastener receives a clapping sound generated by a person clapping his/her hands. The signal-activated fastener includes a sensor, a controller, and a fastener assembly cooperating to cause the bra to unfasten upon reception of the clapping sound.

In one aspect, a bra is disclosed comprising a signal-activated fastener capable of receiving a clapping sound and operative to unfasten the bra when said signal-activated fastener receives the clapping sound generated by a person clapping his/her hands. Preferably, the bra is a strapless bra.

Preferably, the signal-activated fastener comprises a sensor capable of sensing pressure waves generated by the clapping sound and operative to generate an electric signal, a controller responsive to the electric signal and operative to generate a control signal, and a fastener assembly comprising, a ferrous component attached to a first front side of the bra and an electromagnet attached to a second front side of the bra and magnetically coupled with the ferrous component thereby fastening the bra, wherein the electromagnet is responsive to the control signal and operative to demagnetize thereby decoupling from the ferrous component and causing the bra to unfasten. Preferably, the sensor is a microphone. Preferably, the controller is a microprocessor. Preferably, the controller generates the control signal upon verifying that the electrical signal comprises two consecutive claps within a predetermined time interval. Preferably, the controller generates the control signal upon verifying that the electrical signal comprises a single clap having a predetermined amplitude.

In another aspect, a method is disclosed whereby a bra is unfastened via a signal-activated fastener. The method comprises receiving a clapping sound via the signal-activated fastener and unfastening the bra via the signal-activated fastener when said signal-activated fastener receives the clapping sound generated by a person clapping his/her hands.

Preferably, the step of receiving a clapping sound via the signal-activated fastener comprises sensing pressure waves generated by the clapping sound via a sensor included in the signal-activated fastener and wherein the step of unfastening the bra via the signal-activated fastener comprises generating an electric signal via the sensor, responding to the electric signal via a controller included in the signal-activated fastener, generating a control signal via the controller, responding to the control signal via an electromagnet included in a fastener assembly included in the signal-activated fastener, said fastener assembly comprising a ferrous component attached to a first front side of the bra, said electromagnet attached to a second front side of the bra and magnetically coupled with the ferrous component thereby fastening the bra, and demagnetizing the electromagnet thereby decoupling from the ferrous component and causing the bra to unfasten.

Preferably, the step of generating the control signal via the controller comprises generating the control signal upon verifying that the electrical signal comprises two consecutive claps within a specific time interval. Preferably, the step of generating the control signal via the controller comprises generating the control signal upon verifying that the electrical signal comprises a single clap having a predetermined amplitude.

The present invention also discloses a garment, including a method of operation, which comprises a signal-activated fastener whereby a signal is received and compared with a predetermined signal. Upon a substantial match between the received and predetermined signals, the garment is controllably fastened or unfastened.

In one aspect, a signal-activated garment is disclosed comprising a signal-activated fastener responsive to a signal and operative to at least one of fasten and unfasten the garment. Preferably, the signal-activated fastener comprises a sensor, a fastener, and a controller whereby the controller receives a signal, via the sensor, and generates a control signal, operative on the fastener, when the signal substantially matches a predetermined signal. Preferably, the sensor is one of as biometric, pressure, and optical sensor. Preferably, the biometric signal is one of a voice or fingerprint signal. In another aspect, a signal-activated garment is disclosed comprising a signal-activated fastener responsive to a signal and operative to at least one of fasten and unfasten an object to/from the garment.

In another aspect, a method is disclosed whereby a garment is fastened/unfastened via a signal-activated fastener. The method comprises receiving a signal via the signal-activated fastener and at least one of fastening and unfastening the garment via the signal-activated fastener according to the signal. In another aspect, a method is disclosed whereby an object is fastened/unfastened to/from a signal-activated garment via a signal-activated fastener. The method comprises receiving a signal via the signal-activated fastener and at least one of securing and releasing the object to/from the signal-activated garment via the signal-activated fastener according to the signal

DETAILED DESCRIPTION OF THE PRESENTLY PREFERRED EMBODIMENTS

Figure 1:
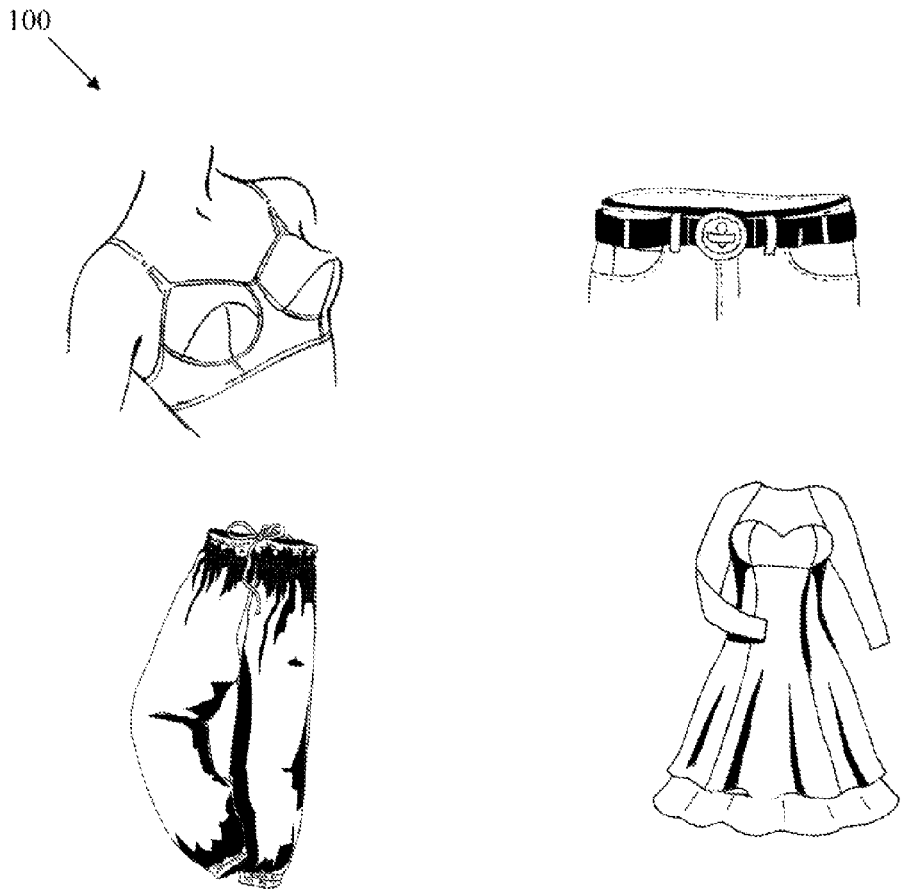
FIG. 1 shows various garments 100 that may be fastened/unfastened via a signal-activated fastener according to the present invention.

FIG. 1 shows various garments 100 that may be fastened/unfastened via a signal-activated fastener. According to the present invention, a brassiere, a belt, trousers, and a dress may be equipped with a signal-activated fastener so that they may be fastened or unfastened when a controller, included in the signal-activated fastener, ascertains a match between a received signal and a predetermined signal stored in the memory of the controller. In another embodiment of the present invention, an object, such as a weapon, communication device, article of clothing, may he secured/released to/from the garment via the signal-activated fastener.

The present invention utilizes the presently known authentication technology to arrive at a garment that maybe controllably fastened or unfastened. Voice and fingerprint identifications are among the many authentication systems presently known to skilled artisans. Voice verification is conceptually similar to fingerprinting. It is common knowledge that each person's fingerprints have unique characteristics that can be used to distinguish one person from another. It has also been proven that each person can be identified by the unique features of his or her vocal characteristics and speaking patterns. Biometric voice verification is the process of comparing a voice sample with a stored, digital voice model, or voiceprint, for the purpose of verifying identity. A voiceprint is a digital representation of some of the unique characteristics of an individual's voice, including physiological characteristics of the nasal passages and vocal chords, as well as the frequency, cadence and duration of the vocal pattern.

In one instance, a brassiere comprises a signal-activated fastener that secures the brassiere on a woman's body. A general construction of the signal-activate fastener may require a power source such as a battery, a locking/unlocking device (fastener) such as an actuator, a sensor such as a biometric sensor, and a controller coupled with the sensor and the locking/unlocking device and including a microprocessor with all the required peripherals including software, known to skilled artisan, wherein said controller is responsive to the signal generated by the sensor and operative to apply a signal to the locking/unlocking device, upon recognition of the biometric quantity, i.e., one or more intrinsic physical or behavioural traits, to close/open the brassiere.

Figure 2:
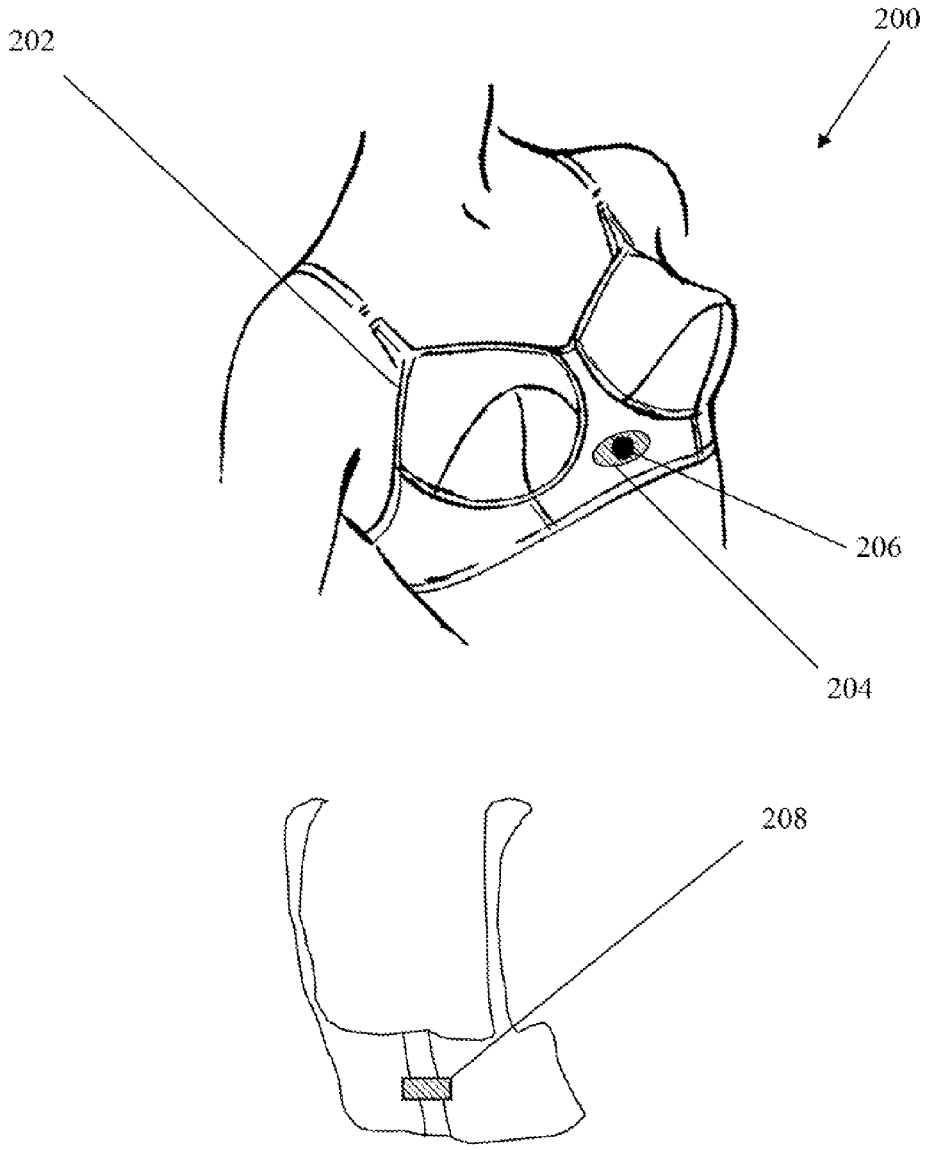
FIG. 2 shows a preferred embodiment of a signal-activated brassiere 200 comprising a signal-activated fastener.

FIG. 2 shows a preferred embodiment of a clap-off bra 200 comprising a clap-off-activated fastener. The bra 202 comprises a clap-off -activated fastener which includes a controller 204, a sensor 206, and a fastener 208. According to one preferred embodiment, the controller 204 comprises a battery as its power source and a microprocessor to process the signal received by the sensor 206. Preferably, the sensor 206 is a microphone which generates an electrical signal when it senses pressure waves generated by the clapping sound. The controller 204 receives the electrical signal, processes the signal, and verifies that the signal comprises two consecutive claps within a predetermined time interval. The controller 204 then generates a control signal, operative on the fastener 208, to unfasten the bra 202. In another instance, the controller 204 receives the electrical signal, processes the signal, and verifies that the signal comprises a single dap having a predetermined amplitude, i.e., decibel level.

In one instance, an individual, wearing the signal-activated bra 200, manually fastens the bra 202 via the fastener 208. The sensor 206 receives sound waves that are generated by another individual clapping his/her hands. The controller 204 processes the signal and unfastens the bra 202 when it determines that there are two consecutive claps within a predetermined time interval.

In another embodiment, the signal-activated brassier 200 comprises a voice-activated fastener. The brassier 202 comprises a voice-activated fastener which includes a controller 204, a sensor 206, and a fastener 208. According to one preferred embodiment, the controller 204 comprises a battery as its power source and a microprocessor to process the signal received by the sensor 206. Preferably, the sensor 206 comprises a biometric sensor, such a biometric voice sensor. The controller 204 receives a voice signal via the biometric voice sensor 206, processes the signal, and compares the signal with a predetermined signal. If there is a substantial match between the two signals, the controller 204 generates a control signal, operative on the fastener 208, to controllably fasten/unfasten the brassiere 202.

In one instance, an individual, wearing the signal-activated brassiere 200, manually fastens the brassiere 202 via the fastener 208. The sensor 206 receives a voice signal, generated by another individual, and the controller 204 processes the signal and unfastens the brassiere 202 when a match is found. Accordingly, the brassiere 202 may only be automatically unfastened upon verification of the voice of the other individual. In another embodiment, the controller 204 verifies the voice signal when the other individual provides the correct password and then applies a control signal to the fastener 208 to fasten/unfasten the garment.

In another embodiment, the sensor 206 comprises a biometric sensor, such as a biometric fingerprint sensor. The controller 204 receives a fingerprint signal via the biometric fingerprint sensor 206, processes the signal, and compares the signal with a predetermined signal. If there is a substantial match between the two signals, the controller 204 generates a control signal, operative on the fastener 208, to controllably fasten/unfasten the brassiere 202.

In one instance, an individual, wearing the signal-activated brassiere 200, manually fastens the brassiere 202 via the fastener 208. The sensor 206 receives a fingerprint signal, generated by another individual, and the controller 204 processes the signal and unfastens the brassiere 202 when a match is found. Accordingly, the brassiere 202 may only be automatically unfastened upon verification of the fingerprint of the other individual.

Figure 3:
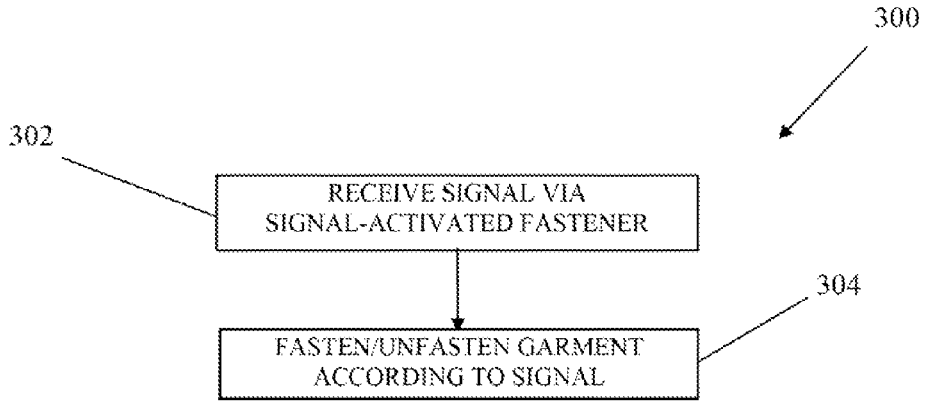
FIG. 3 shows a preferred method of fastening/unfastening a garment via a signal-activated fastener according to the present invention.

FIG. 3 shows a flow diagram 300 of one method of fastening/unfastening garment according to the present invention. The preferred method comprises receiving a signal, such as a biometric signal, pressure signal, optical signal, via a signal-activated fastener at 302, and at least one of fastening and unfastening the garment according to the signal at 304.

Figure 4:
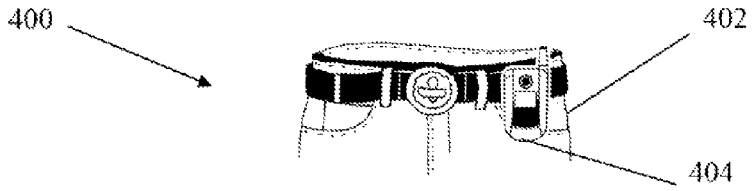
FIG. 4 shows a preferred embodiment of a signal-activated garment 400 comprising a voice activated fastener operable to secure/release an object to the garment.

FIG. 4 shows a preferred embodiment 400 of a signal-activated garment 402 comprising a voice activated fastener. According to this embodiment, an object, such as a cell phone 404, may be secured/released to/horn the signal-activated garment 402 via a signal activated fastener, such as a voice-activated fastener which includes a controller, such as the controller 204, a sensor, such as the sensor 206, and a fastener, such as the fastener 208. According to one preferred embodiment, the controller 204 comprises a battery as its power source and a microprocessor to process the signal received by the sensor 206. Preferably, the sensor 206 comprises a biometric sensor, such a biometric voice sensor. The controller 204 receives a voice signal via the biometric voice sensor 206, processes the signal, and compares the signal with a predetermined, signal. If there is a substantial match between the two signals, the controller 204 generates a control signal, operative on the fastener 208, to controllably fasten/unfasten the cell phone 404 to the signal-activated garment 402.

In one instance, an individual, wearing the signal-activated garment 402, manually fastens the cell phone 404 via the fastener 208. The sensor 206 receives a voice signal, generated by the individual, and the controller 204 processes the signal and unfastens the cell phone 404 when a match is found. Accordingly, the cell phone 404 may only be automatically unfastened upon verification of the voice of the individual. In another embodiment, the controller 204 verifies the voice signal when the individual provides the correct password and then applies a control signal to the fastener 208 to fasten/unfasten the cell phone 404.

In another embodiment, the sensor 206 comprises a biometric sensor, such as a biometric fingerprint sensor. The controller 204 receives a fingerprint signal via the biometric fingerprint sensor 206, processes the signal, and compares the signal with a predetermined signal. If there is a substantial match between the two signals, the controller 204 generates a control signal, operative on the fastener 208, to controllably secure/release the cell phone 404 to/from the signal-activated garment 402.

In one instance, an individual, wearing the signal-activated garment 402, manually fastens the cell phone 404 via the fastener 208. The sensor 206 receives a fingerprint signal, generated by the individual, and the controller 204 processes the signal and unfastens the cell phone 404 when a match is found. Accordingly, the cell phone 404 may only be automatically unfastened upon verification of the fingerprint of the individual.

Figure 5:
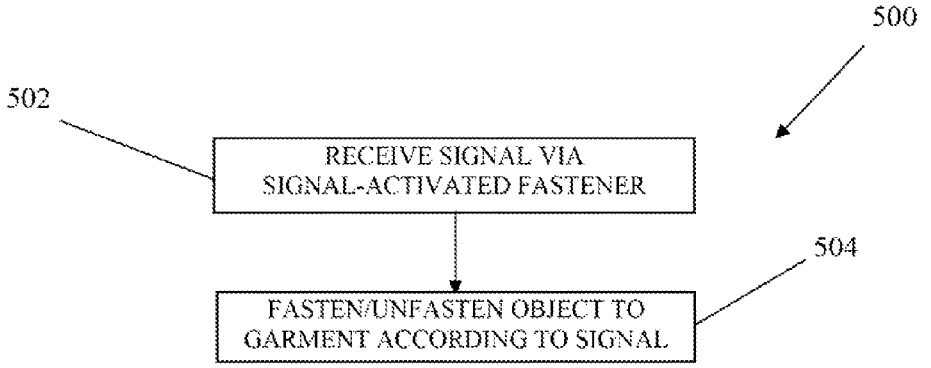
FIG. 5 shows a preferred method of fastening/unfastening an object to a garment via a signal-activated fastener according to the present invention.

FIG. 5 shows a flow diagram 500 of one method of fastening/unfastening an object to a signal-activated garment of the present invention. The preferred method comprises receiving a signal, such as a biometric signal, pressure signal, optical signal, via a signal-activated fastener at 502, and at least one of fastening and unfastening the object to the signal-activated garment according to the signal at 304.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. A bra comprising a signal-activated fastener capable of receiving sound pressure generated by a clapping sound and operative to unfasten the bra when said signal-activated fastener receives the clapping sound generated by a person clapping his/her hands, wherein the signal-activated fastener comprises:

(a) a sensor capable of sensing pressure waves generated by the clapping sound and operative to generate an electric signal;

(b) a controller responsive to the electric signal and operative to generate a control signal; and (c) a fastener assembly comprising an actuator, said actuator comprising:

(i) a ferrous component attached to a first front side of the bra; and (ii) an electromagnet attached to a second front side of the bra and magnetically coupled with the ferrous component thereby fastening the bra;

wherein the electromagnet is responsive to the control signal and operative to demagnetize thereby decoupling from the ferrous component and causing the bra to unfasten.

2. The bra of claim 1, wherein the sensor is a microphone.

3. The bra of claim 1, wherein the controller is a microprocessor.

4. The bra of claim 1, wherein the controller generates the control signal upon verifying that the electrical signal comprises two consecutive claps within a predetermined time interval.

5. The bra of claim 1, wherein the controller generates the control signal upon verifying that the electrical signal comprises a single clap having a predetermined amplitude.

6. A method for unfastening a bra, said bra comprising a signal-activated fastener, said method comprising:

(a) receiving sound pressure generated by a clapping sound via the signal-activated fastener; and (b) unfastening the bra via the signal-activated fastener when said signal-activated fastener receives the clapping sound generated by a person clapping his/her hands wherein the step of receiving a clapping sound via the signal-activated fastener comprises:

(i) sensing pressure waves generated by the clapping sound via a sensor included in the signal-activated fastener;

wherein the step of unfastening the bra via the signal-activated fastener comprises:

(i) generating an electric signal via the sensor;

(ii) responding to the electric signal via a controller included in the signal-activated fastener;

(iii) generating a control signal via the controller;

(iv) responding to the control signal via a fastener assembly included in the signal-activated fastener, said fastener assembly comprising an actuator, said actuator comprising a ferrous component attached to a first front side of the bra, and an electromagnet attached to a second front side of the bra and magnetically coupled with the ferrous component thereby fastening the bra; and (v) demagnetizing the electromagnet thereby decoupling from the ferrous component and causing the bra to unfasten.

7. A panties comprising a signal-activated fastener capable of receiving sound pressure generated by a clapping sound and operative to unfasten the panties when said signal-activated fastener receives the clapping sound generated by a person clapping his/her hands, wherein the signal-activated fastener comprises:

(a) a sensor capable of sensing pressure waves generated by the clapping sound and operative to generate an electric signal;

(b) a controller responsive to the electric signal and operative to generate a control signal; and (c) a fastener assembly comprising an actuator, said actuator comprising:

(i) a ferrous component attached to a first side of the panties; and (ii) an electromagnet attached to a second side of the panties and magnetically coupled with the ferrous component thereby fastening the panties;

wherein the electromagnet is responsive to the control signal and operative to demagnetize thereby decoupling from the ferrous component and causing the panties to unfasten.

8. The panties of claim 7, wherein the sensor is a microphone.

9. The panties of claim 7, wherein the controller is a microprocessor.

10. The panties of claim 7, wherein the controller generates the control signal upon verifying that the electrical signal comprises two consecutive claps within a predetermined time interval.

11. The panties of claim 7, wherein the controller generates the control signal upon verifying that the electrical signal comprises a single clap having a predetermined amplitude.

* * * * *